US006005196A

United States Patent [19]

Spillyards

[11] Patent Number: 6,005,196

[45] Date of Patent: Dec. 21, 1999

[54] TRIGGERED WILDLIFE GUARD FOR ELECTRICAL INSULATOR BUSHINGS

[75] Inventor: Jim R. Spillyards, Maumelle, Ark.

[73] Assignee: Central Moloney, Inc., Pine Bluff, Ark.

[21] Appl. No.: 09/110,159

[22] Filed: Jul. 6, 1998

[51] Int. Cl.[6] ..... H01B 17/00; H01B 17/38; H01B 17/56

[52] U.S. Cl. ..... 174/138 F; 174/5 R; 174/139; 174/138 R

[58] Field of Search ..... 174/5 R, 138 F, 174/138 R, 139, 135, 40 R, 140 H, 180, 55 B, 5 G

[56] References Cited

U.S. PATENT DOCUMENTS

| | | | |
|---|---|---|---|
| 2,575,480 | 11/1951 | Zimsky | 174/135 |
| 2,875,267 | 2/1959 | Sutton, Jr. | 174/5 R |
| 2,946,841 | 7/1960 | Wagner | 174/5 R |
| 3,042,736 | 7/1962 | Salisbury | 174/5 R |
| 3,238,291 | 3/1966 | Bosch et al. | 174/138 F |
| 3,510,568 | 5/1970 | Cochran | 174/139 |
| 3,824,676 | 7/1974 | Ebert | 29/450 |
| 4,845,307 | 4/1989 | Cumming et al. | 174/139 |
| 5,153,383 | 10/1992 | Whited et al. | 174/139 |
| 5,679,922 | 10/1997 | Harben | 174/5 R |

OTHER PUBLICATIONS

"One Piece Wildlife Protector", Fargo Mfg. Co., Inc., Sep. 1988, p. 12.

"One Piece Wildlife Protector", Fargo Mfg. Co., Inc., Oct. 1990, p. 11.

"Bird Guard", Hendrix, unknown date.

"Custom Cappter Wildlife Protector", Custom Plastics, Inc., unknown date.

"Underground Power Products" under "Wildlife Protectors", Preformed Line Products, unknown date.

"Bushing and Wildlife Protector", Fargo Mfg. Co., Inc., Dec. 1977, p. 60.

"The Bird Guard", Product News, Hendrix Wire & Cable Corp., unknown date.

"The Squirrely", H.J. Arnett Industries, Inc., unknown date.

*Primary Examiner*—Kristine Kincaid
*Assistant Examiner*—Mark Olds
*Attorney, Agent, or Firm*—Sixbey, Friedman, Leedom & Ferguson; Daniel W. Sixbey

[57] ABSTRACT

The triggered wildlife guard is formed from first and second body sections hinged together to pivot between an open and a closed position. In the closed position, the first and second body sections latch together to form a hollow body open at a first end and having a top wall at a second end which defines a conductor opening. A spring assembly biases the first and second body sections toward the closed position, and a releasable trigger extends between the first and second body sections to hold them in the open position until the trigger is released. A wire stop formed on the first and second body sections bridges a gap therebetween in the open position to retain a bushing lead wire in the conductor opening.

16 Claims, 2 Drawing Sheets

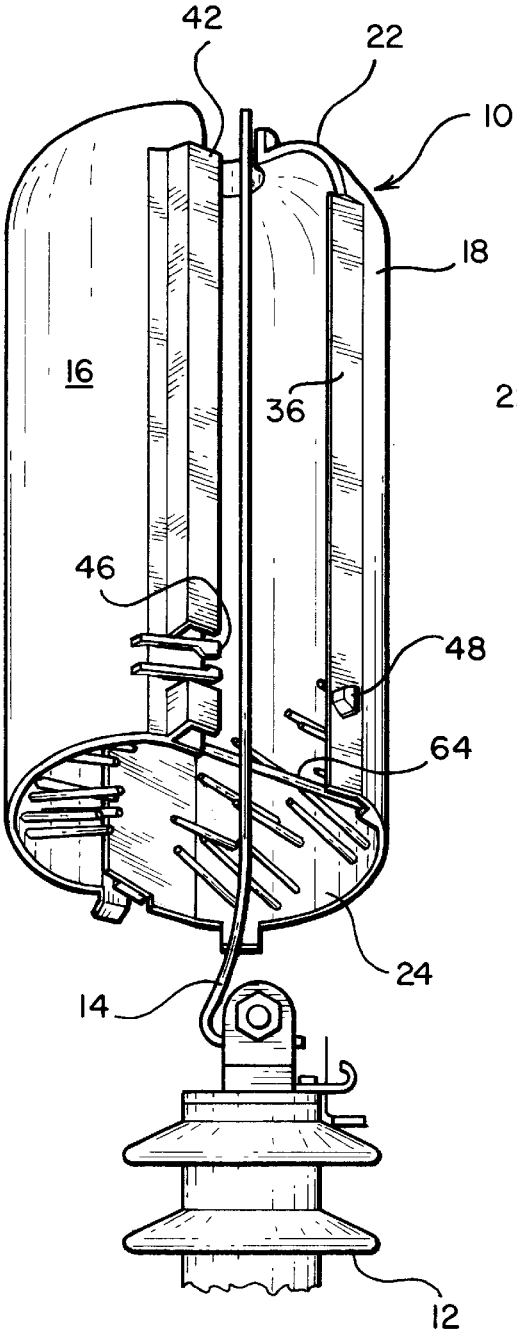
FIG. 1
FIG. 2
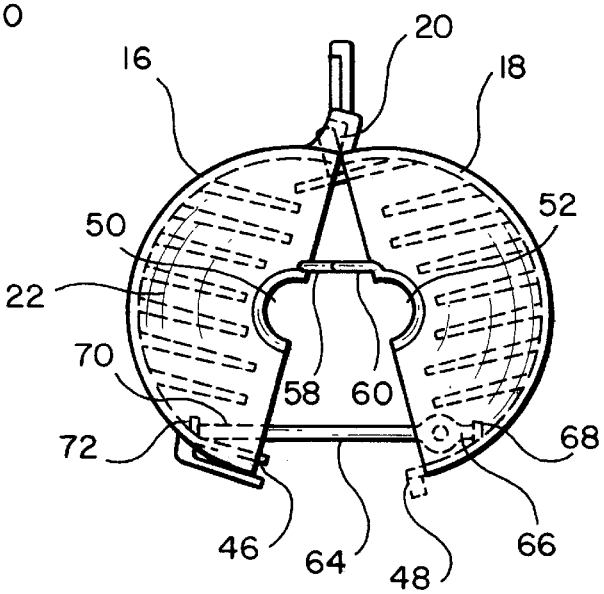
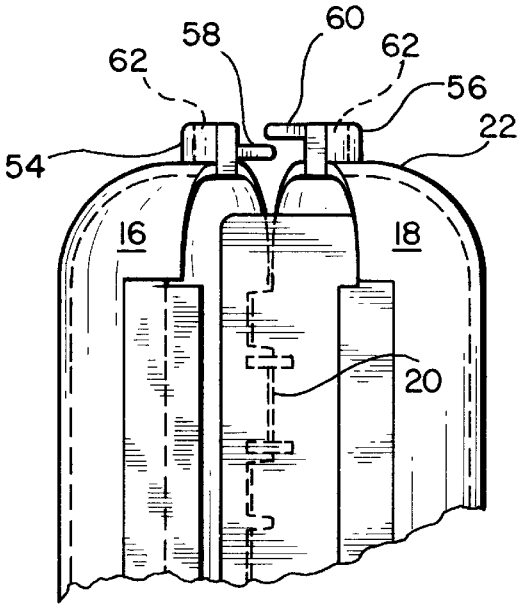
FIG. 3

TRIGGERED WILDLIFE GUARD FOR ELECTRICAL INSULATOR BUSHINGS

FIELD OF THE INVENTION

The present invention relates generally to an insulating wildlife guard for the electrical bushing of a distribution voltage transformer and more particularly to a novel and improved wildlife guard which is closed and locked by the activation of a trigger mechanism.

BACKGROUND OF THE INVENTION

Many electric utility transformers are outdoor installations which in the past, have been subjected to possible damage and the creation of power outages due to contact with small mammals and birds. These animals tend to contact the energized conductors leading to transformer insulator bushings thereby creating a short circuit condition.

Most new transformers are now installed with protective, insulating guards on the transformer bushings, and these guards are easily installed by hand since this is done before the new transformer is energized. However, many transformers installed in the past did not include bushing guards of any type, and utilities are striving to retrofit these installations with guards which can be installed without disconnecting the power to the transformer. One such wildlife guard, shown in U.S. Pat. No. 4,845,307 to Cumming et al., is formed by a one piece unit having a lengthwise slot through which the live conductor to the transformer bushing is forced during the installation of the guard. This is somewhat difficult to accomplish from a distance, since the guard must be positively forced over a live conductor, and generally the use of a bucket truck and line crew would be required so that the guard could be brought close to the overhead transformer bushing for installation.

In an attempt to make installation easier, one piece tubular guards formed of two hinged semicircular cylinders have been designed to fit around a bushing and to engage when closed. Again, the problem with these hinged shields or guards is that they must first be carefully positioned relative to the insulator and live wire to the insulator and then the two hinged halves must be forced together around the insulator and locked in the closed position. This again is very difficult to achieve from a distance, and requires the use of a bucket truck and line crew to close the guard.

SUMMARY OF THE INVENTION

It is a primary object of the present invention to provide a novel and improved triggered wildlife guard which may be easily installed on a transformer bushing without disconnecting the primary electrical lead from the bushing.

Another object of the present invention is to provide a novel and improved triggered wildlife guard which may be easily installed using a conventional hot stick without requiring the use of a bucket truck and line crew.

A further object of the present invention is to provide a novel and improved triggered wildlife guard which, upon activation of a trigger, automatically closes and locks around the energized lead wire for a transformer bushing and which may then be easily positioned in the locked closed state over the transformer bushing terminal.

A still further object of the present invention is to provide a novel and improved triggered wildlife guard which automatically closes when triggered so that it may be easily installed from the ground with a long hot stick.

These and other objects of the present invention are accomplished by providing a novel and improved triggered wildlife guard which is substantially cylindrical in form and has a domed top wall with a central opening. The wildlife guard is a unitary unit having two side sections which are hinged along one edge and which latch together along an opposite edge. Spring units are provided along the hinged edge to bias the unit toward a closed and latched configuration, and a trigger mechanism is provided to hold the two halves of the wildlife guard apart. This trigger mechanism is released by contact with the lead wire for a transformer bushing and a stop is provided across the opening in the domed top of the wildlife guard to ensure that the energized lead wire is properly positioned before the guard is snapped to a closed and locked position. Flexible fingers are provided at the bottom of the guard which permit the guard to be moved downwardly over a transformer bushing terminal and which engage the bushing terminal help position the guard firmly on top of the bushing.

BRIEF DESCRIPTION OF THE DRAWINGS

FIG. 1 is a perspective view of the triggered wildlife guard of the present invention in an open condition around a conductor for a transformer bushing;

FIG. 2 is a top plan view of the wildlife guard of FIG. 1;

FIG. 3 is a view in front elevation showing the upper portion of the wildlife guard of FIG. 1;

DESCRIPTION OF THE PREFERRED EMBODIMENT

Figure 4:
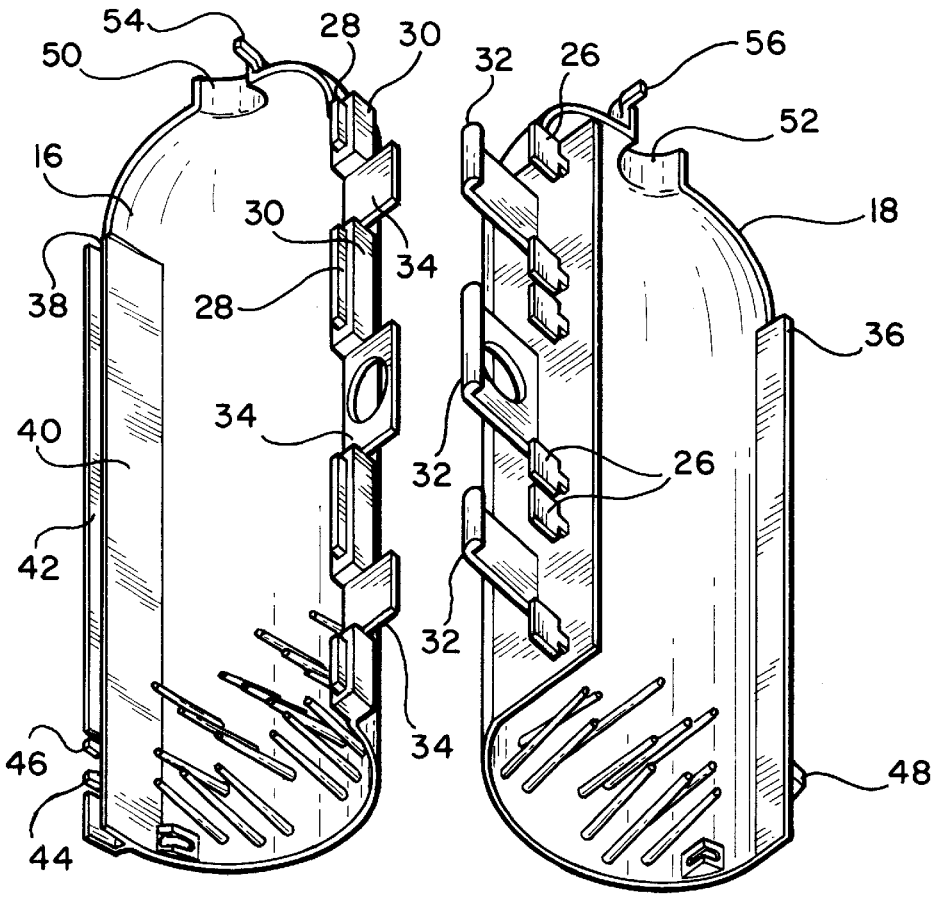
FIG. 4 is an exploded perspective view of the wildlife guard of FIG. 1.

Referring now to the drawings, the triggered wildlife guard of the present invention indicated generally at 10 is adapted to fit over a transformer bushing terminal 12 connected to an electrical lead line 14. The wildlife guard is formed from two segmental halves 16 and 18 which are hinged together along a hinge line 20. When the halves 16 and 18 are brought together, they form a cylindrical body having a closed domed top 22 at one end and a large circular opening 24 at the opposite end. The segmental halves 16 and 18 are molded from an electrically insulated, weather-resistant plastic such as polypropylene, and when joined formed a unitary, hinged unit. To hinge the halves of the wildlife guard together, projecting hinge elements 26 are integrally molded with the segmental half 18 and these hinge elements slide into slots 28 in hinge receiving blocks 30 molded on the segmental half 16. When the hinge elements 26 are mounted in the blocks 30, molded projecting springs 32 on the segmental half 18 engage molded projecting spring pads 34 on the segmental half 16 and spring bias the segmental halves of wildlife guard to a closed and latched position. The springs 32 are flexed and placed under tension by contact with the spring pads 34 when the hinge elements 26 are in placed in the receiving blocks 30.

In the closed and latched position of the triggered wildlife guard 10, a flange 36 along a leading edge of the segmental half 18 which is opposite to the hinge line 20 is received in a channel 38 between spaced flanges 40 and 42 molded on a leading edge of the segmental half 16 opposite to the hinge line. The bottom of the flange 42 is cut away at 44, and in the cutaway portion there is formed a molded latch 46 which engages a projection 48 projecting outwardly from the flange 36. When the segmental halves 16 and 18 are driven to a closed position about the hinge line 20 by the action of the springs 32, the projection 48 enters between the flexible hooked arms of the latch 46 and is retained thereby to lock the wildlife guard in the closed position. The combination of the flange 36 and the channel 38 insures that the projection 48 is guided into latching contact with the latch 46.

When the wildlife guard is latched in the closed position, a circular opening is formed in the domed top wall 22 by arcuate openings 50 and 52 formed in the segmental halves 16 and 18 respectively. Projecting above the arcuate openings 50 and 52 are L-shaped wire stops 54 and 56 having legs 58 and 60 which bridge the distance between the segmental halves of the wildlife guard when the segmental halves are open. As will be noted from FIG. 2, these legs 58 and 60 ensure that a wire 14 is positioned between the arcuate openings 50 and 52 when the segmental halves of the wildlife guard are open and that the wire is prevented from passing beyond the arcuate openings into the space between the segmental halves. The wire stops 54 and 56 include a cutaway portion 62 to receive the opposed leg 58 or 60 when the segmental halves of the wildlife guard close.

Figure 5:
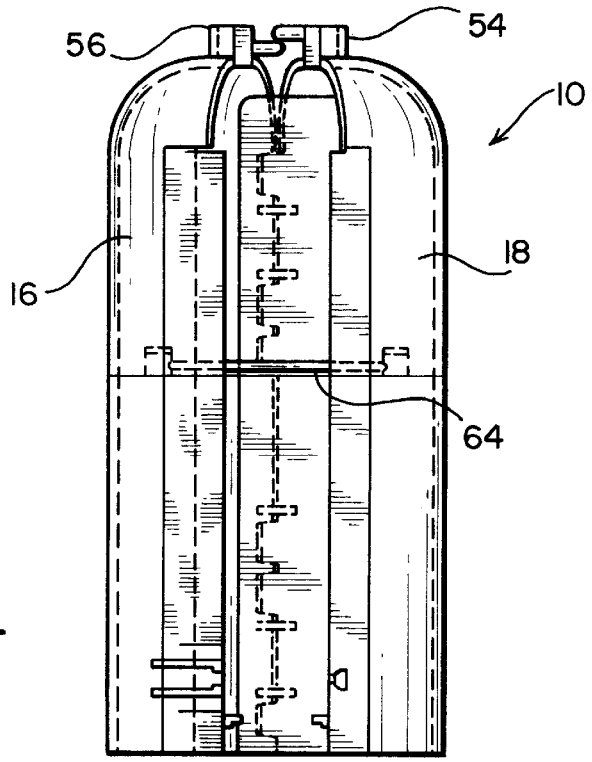
FIG. 5 is a view in front elevation of an embodiment of the triggered wildlife guard of the present invention.

To hold the wildlife guard open for installation, a molded, electrically insulated trigger bar 64 is provided. This trigger bar is positioned adjacent to but inside the flanges 36 and 40, and has at least one free end 66 which engages a flat ledge 68 formed on the segmental half 18. The opposite end of the trigger bar 70 may be connected to the segmental half 16 by a thin, flexible plastic hinge 72. It will be noted in FIG. 1 that the trigger bar 64 is positioned adjacent the large opening 24 for the wildlife guard, while in FIG. 5, the trigger bar is positioned toward the center of the wildlife guard. The trigger bar may be connected at one end 70, as previously described, or both ends of the trigger bar may be free and rest against flat portions formed on the segmental halves 16 and 18.

To install the wildlife guard 10 on a bushing 12, an insulating hot stick is used to raise the wildlife guard above the bushing as shown in FIG. 1. Then, the top of the wildlife guard is moved inwardly until the energized lead 14 contacts the legs 58 and 60 of the wire stops 54 and 56. Next the lower portion of the wildlife guard is moved inwardly until the energized lead 14 contacts the trigger rod 64. As will be noted from FIG. 2, the trigger rod is inside the flanges 36 and 40 so that when the trigger rod pivots away from the flat portion 68 allowing the segmental halves 16 and 18 to snap together and lock, the lead wire 14 will be inside the closed wildlife guard. The trigger rod 64 is pivoted about the hinge 72 away from the flat 68 by moving the lower end of the wildlife guard 10 inwardly to force the lead wire 14 against the trigger rod 64 to dislodge the trigger rod. The trigger rod could additionally be dislodged by tapping the rod with a second hot stick.

Once the trigger rod 64 is dislodged and the segmental halves of the wildlife guard 10 spring shut around the hinge line 20 and lock, the wildlife guard will be closed about the lead wire 14 above the bushing 12. Now the wildlife guard can be moved down the lead wire and over the bushing terminal 12. Adjacent the bottom opening 24 of the wildlife guard are inwardly projecting flexible fingers 74 which are molded integrally with the segmental halves 16 and 18. These flexible projecting fingers extend inwardly around the circumferential extent of the wildlife guard. This enables these fingers to snap over the projections on the bushing 12 as a wildlife guard is lowered into place and to hold the wildlife guard in position over the bushing. These fingers also prevent wildlife from entering the wildlife guard through the opening 24.

The triggered wildlife guard of the present invention is easily installed on a bushing 12 using a conventional hot stick, and may easily be installed from the ground. The problem of the wire riding between the hinged halves of the wildlife guard which might be experienced with a normal hinged guard is alleviated by the wire positioning stops 54 and 56. Also, it is now not necessary to manually close an attempt to latch the two halves of the pivoted wildlife guard while maintaining the guard in position. Instead, the halves spring together when the trigger rod is disengaged and the flange 36 passes between the flanges 38 and 40 and positively guides the projection 48 into engagement with the latch 46. Thus, the closing and latching operation which is extremely awkward with the pivoted halves of a wildlife guard, and generally requires the use of a bucket truck and line crew is accomplished automatically with the triggered wildlife guard.

INDUSTRIAL APPLICABILITY

The triggered wildlife guard 10 provides a protective cover for a transformer bushing and lead wire which is designed to prevent power outages and equipment damage which might be caused by wildlife contact with an energized bushing. The wildlife guard may be easily installed using a single hot stick, and flexible fingers at the base of the wildlife guard fit the guard to bushing terminals of various sizes.

We claim:

1. A triggered wildlife guard for an insulator bushing with an energized conductor extending outwardly from said bushing comprising:

a hollow body formed from a first body section and a second body section which engage to form said hollow body, said hollow body having a first open end and a second end spaced from and opposite to said first open end, said second end including a conductor opening for said conductor, a hinge assembly connected to said first and second body sections to permit said body sections to pivot together into engagement in a closed position and to pivot away from engagement to an open position, a spring assembly connected to said hollow body to bias said first and second body sections together into engagement, and a releasable trigger for extending between said first and second body sections to hold said body sections open against the bias of said spring assembly.

2. The wildlife guard of claim 1 wherein said first and second body sections are formed with top wall sections to provide a top wall at the second end of said hollow body when said first and second body sections are in the closed position, said conductor opening being formed in said top wall with said first and second body sections in the closed position by opening portions formed in said first and second body sections, and wire stops are formed on the top wall sections of said first and second body sections, said wire stops bridging a space between the opening portions of said first and second body sections created with said first and second body sections in the open position to retain said energized conductor within the confines of said opening portions.

3. The wildlife guard of claim 2 wherein said space between the opening portions of said first and second body sections extends from said hinge assembly to an inner side of said opening portions adjacent to said hinge assembly, said wire stops being positioned to bridge said space at the inner side of said opening portions.

4. The wildlife guard of claim 3 wherein said space is closed by the top wall sections of said first and second body sections when said first and second body sections are in the closed position.

5. The wildlife guard of claim 1 wherein said first body section includes a first leading edge spaced from said hinge assembly and said second body section includes a second leading edge spaced from said hinge assembly, said first and second leading edges engaging with said first and second body sections in the closed position and being spaced apart with said first and second body sections in the open position.

6. The wildlife guard of claim 5 wherein said releasable trigger is formed by a trigger bar which bridges the space between said first and second leading edges to hold said first and second body sections in the open position against the bias of said spring assembly, said trigger bar engaging said first and second body sections adjacent to said first and second leading edges within the confines of said first and second body sections.

7. The wildlife guard of claim 6 wherein a first end of said trigger bar is secured to one of said first and second body sections and a second end of said trigger bar is free of attachment.

8. The wildlife guard of claim 5 wherein said first and second leading edges are each provided with a latching mechanism, the latching mechanism of said first leading edge engaging the latching mechanism of said second leading edge to lock said first and second body sections together when said first and second leading edges engage.

9. The wildlife guard of claim 8 wherein one of said first and second leading edges includes spaced flanges to form a channel and the remaining leading edge includes a single flange which enters said channel when the first and second leading edges move into engagement to guide said latching mechanisms of said first and second leading edges into locking engagement.

10. The wildlife guard of claim 9 wherein said releasable trigger is formed by a trigger bar which bridges the space between said first and second leading edges to hold said first and second body sections in the open position against the bias of said spring assembly, said trigger bar engaging said first and second body sections adjacent to said first and second leading edges within the confines of said first and second body sections.

11. The wildlife guard of claim 10 wherein said first and second body sections are formed with top wall sections to provide a top wall at the second end of said hollow body when said first and second body sections are in the closed position, said conductor opening being formed in said top wall with said first and second body sections in the closed position by opening portions formed in said first and second body sections, and wire stops are formed on the top wall sections of said first and second body sections, said wire stops bridging a space between the opening portions of said first and second body sections created with said first and second body sections in the open position to retain said energized conductor within the confines of said opening portions.

12. The wildlife guard of claim 11 wherein said space between the opening portions of said first and second body sections extends from said hinge assembly to an inner side of said opening portions adjacent to said hinge assembly, said wire stops being positioned to bridge said space at the inner side of said opening portions.

13. The wildlife guard of claim 12 wherein said space is closed by the top wall sections of said first and second body sections when said first and second body sections are in the closed position.

14. The wildlife guard of claim 13 wherein said first and second body sections include a plurality of spaced, inwardly projecting flexible fingers, said flexible fingers extending around the open end of said hollow body when said first and second body sections are in the closed position.

15. The wildlife guard of claim 14 wherein said first and second body sections are molded of electrical insulating plastic material, said hinge assembly and spring assembly being attached to at least one of said first and second body sections.

16. The wildlife guard of claim 15 wherein said trigger bar is formed of electrical insulating material.

* * * * *